United States Patent [19]

Lundgren, Jr.

[11] 4,031,538

[45] June 21, 1977

[54] ANTENNA WITH ECHO CANCELLING ELEMENTS

[75] Inventor: Carl William Lundgren, Jr., Colts Neck, N.J.

[73] Assignee: Bell Telephone Laboratories, Incorporated, Murray Hill, N.J.

[22] Filed: July 21, 1975

[21] Appl. No.: 597,367

[52] U.S. Cl. ..... 343/781 CA; 343/782

[51] Int. Cl.[2] ..... H01Q 19/14

[58] Field of Search ..... 343/781, 782, 783, 840, 343/755, 756, 761, 837, 912, 18 R, 18 B, 18 C, 18 D, 18 E

[56] References Cited

UNITED STATES PATENTS

| | | | |
|---|---|---|---|
| 3,133,284 | 5/1964 | Privett et al. | 343/782 |
| 3,231,893 | 1/1966 | Hogg | 343/781 |

*Primary Examiner*—Eli Lieberman
*Attorney, Agent, or Firm*—James F. Hollander

[57] ABSTRACT

In a Cassegrainian antenna, radiation transmitted from the feed system is reflected back as an echo to the feed from the subreflector. In the prior art, a flat plate has been located near the subreflector to return an echo cancelling reflection to the feed in one frequency range. In this disclosure, operation of an echo cancelling device which may be mounted externally on the feed side of the subreflector is extended to two frequency ranges by adding a reflective outwardly-flared wall-like ring around the perimeter of the flat plate. The ring may include two conical segments sized to adjust the relative reflection amplitudes to obtain substantially complete cancellations over broad bandwidths at both frequency ranges. The ring may also be stepped, or serrated, in cross section to avoid unwanted specular reflections and resonances. The dimensions and location of the ring and plate are adjusted by an iterative experimental procedure to obtain optimum dual band cancellations for a given subreflector shape and illumination. The ring and plate may be integral with the subreflector.

10 Claims, 5 Drawing Figures

ANTENNA WITH ECHO CANCELLING ELEMENTS

BACKGROUND OF THE INVENTION

The present invention relates to antennas for the transmission and reception of microwave energy. More particularly, the present invention relates to an improvement to a microwave antenna for reducing undesirable echo reflections to the feed system, which reflections are superposed, delayed, upon the desired transmitted and received microwave energy.

In the field of space communications, a microwave antenna is used to transmit and receive many communications channels. On such antenna is the Cassegrainian antenna, which has a large concave main reflector, a smaller convex subreflector placed forward of the main reflector and a feed system, often located centrally in an opening in the main reflector. Radiation from the feed is reflected from the subreflector to the main reflector and is transmitted from the antenna as a narrow microwave beam.

Unfortunately, some radiation transmitted from the feed is also reflected undesirably back to the feed from the subreflector. This undesirable reflection is called an echo, the echo corresponding with an impedance mismatch, in this case between the feed and the subreflector. The echo causes, for example, an objectionable intermodulation background noise component in frequency division multiplexed FM communications channels which sharply increases as the antenna size and number of channels is increased. See Bell Telephone Laboratories, *Transmission Systems for Communications*, 4th Ed., pp. 517–522, 1970.

Heretofore, undesirable echo reflections have been reduced by placing an essentially flat reflecting plate near the subreflector between the subreflector and the feed system to cancel some of the echo at the feed. When the plate reflects radiation to the feed which is equal in amplitude and 180° out of phase at a given frequency with the echo at the feed location from the rest of the subreflector, complete echo cancellation at that frequency is obtained. As the number of communications channels is increased, however, the frequency range over which the sharply increased echo-caused noise can be acceptably cancelled by a flat plate decreases. Furthermore, some communications systems use distinct frequency ranges for simultaneous transmission and reception. Consequently, as the number of channels is increased to take full economic advantage of the antenna, the echo-caused noise in these frequency ranges rises above an acceptable level if a flat plate is employed. Accordingly, it is an object of the present invention to substantially cancel microwave echo reflections over a wide bandwidth in a microwave antenna.

It is another object of the present invention to substantially eliminate echo-caused channel noise from a Cassegrainian antenna accommodating a large number of communications channels.

It is another object of the present invention to substantially eliminate undesirable echo interference to simultaneously transmitted and received communications channels carried in distinct frequency ranges in a microwave antenna.

Attention is called to the copending application of E. A. Ohm entitled, "Antenna with Echo Cancelling Elements," Ser. No. 597,366, in which there is disclosed a dual frequency echo-cancelling structure having a gridded design. Also, improvements to the gridded design of E. A. Ohm are disclosed in the copending application entitled, "Antenna with Echo Cancelling Elements," Ser. No. 597,368, of G. W. Travis and myself. The present application, by contrast, reveals a dual frequency echo-cancelling structure having a distinctly different design which accomplishes objects including those stated above.

SUMMARY OF THE INVENTION

The present invention is an improvement to a microwave antenna. The microwave antenna includes a feed system, a subreflector, and a main reflector. In the transmit and receive modes in distinct frequency ranges, some echos return from the subreflector to the feeding means incompletely cancelled whether or not a prior art flat plate is used. According to the present invention, the echo cancellation is improved by the addition of a reflective band such as a ring or a polygonal or circular wall having an outwardly flaring inner surface located between the subreflector and the feed system. The band may be joined to the subreflector. In another feature of the invention a flat plate is located between the band and the subreflector, and the flat plate may be joined to the band. The plate and band in turn may be integral with the subreflector or mounted fixed or adjustably with respect thereto. The band or ring, which may include two conical segments, has a significant width aspect so as to provide a combined reflection and effectively cancel echoes simultaneously over broad bandwidths in distinct lower and higher frequency ranges. If the lower and higher frequency ranges are caused to overlap, then a width single-band echo cancellation is obtained. The improved echo cancelling structure can be mounted entirely in front of the subreflector vertex without requiring a large or carefully mated hole for its recessment. Symmetry of the reflective band or ring minimizes channel distortion from undesirable coupling of signals of different polarizations. The simple geometry of the structure is also conductive to minimum retention of ice, insects and wind-blown matter. One-piece construction offers good thermal conduction without mechanical distortions for deicing by rear mounting electrical heaters. The necessity for design consideration of dielectric supports and their mechanical and electrical life is obviated by all-metal design.

BRIEF DESCRIPTION OF THE DRAWINGS

The present invention will be more readily understood by reference to the appended drawings.

DETAILED DESCRIPTION OF THE DRAWINGS

Figure 1:
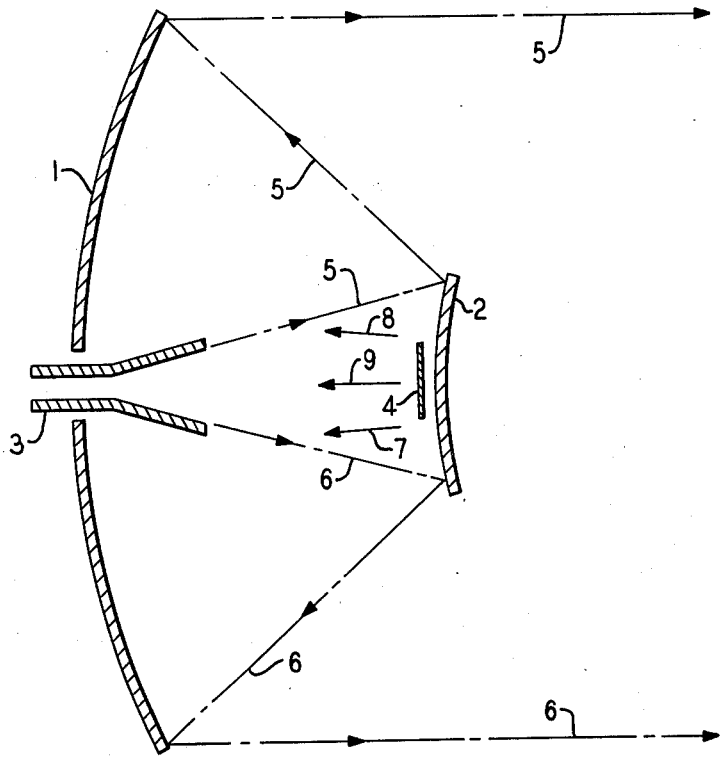
FIG. 1 PRIOR ART
FIG. 1 is a longitudinal cross section of a prior art microwave antenna having a flat echo cancelling plate near the subreflector.

FIG. 1 shows a cross section of a prior art Cassegrainian antenna having a concave paraboloidal main reflector 1, a convex hyperboloidal subreflector 2 and a feed horn 3. Radiation from feed horn 3, indicated by rays 5 and 6, is reflected successively from subreflector 2 and main reflector 1 in the transmission process. Unfortunately, an undesirable echo indicated by rays 7 and 8 is returned from subreflector 2 back to feed horn 3. The undesirable echo, observed at the feed location, is typically about 20 dB below the radiation incident on the subreflector. In a single, narrow frequency range this echo may be reduced to more than 40 dB below the incident radiation by the addition of a carefully sized and positioned flat reflector 4 which reflects a cancellation signal of equal amplitude and opposite phase, indicated by ray 9. In this manner, the echo is effectively cancelled at the feed horn 3 for a single operating frequency range. Unfortunately, the flat reflector does not provide similar effective cancellation over very wide bandwidths or over two distinct frequency ranges. For example, experimentation has shown with one 100-foot diameter Cassegrainian reflector antenna design including a shaped 10-foot subreflector, that the subreflector echo return loss measured at the feed could not be made better than 35.5 dB for the worst case frequency in the common carrier ranges 3725 to 4225 GHz and 5925 through 6425 GHz taken together.

Figure 2:
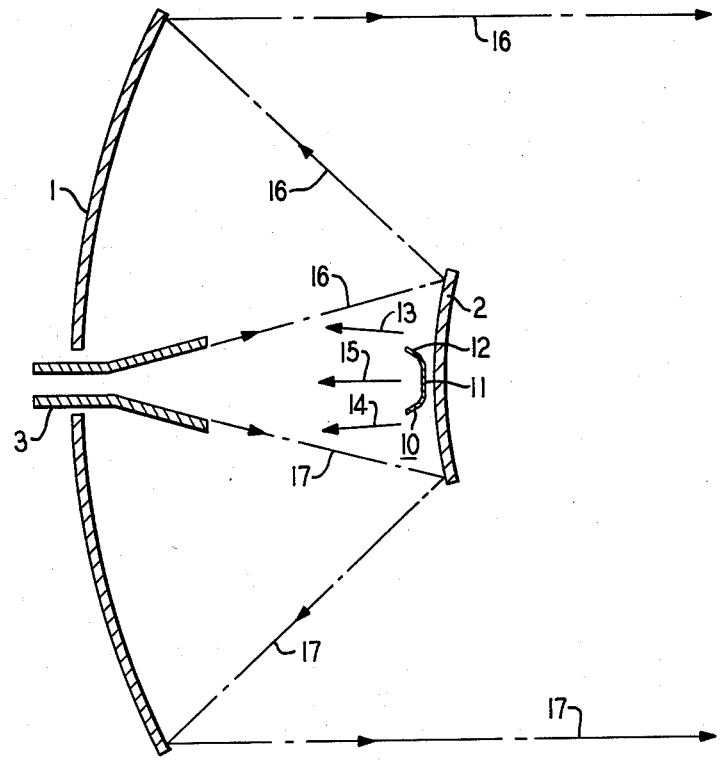
FIG. 2 is a longitudinal cross section of a microwave antenna and plate similar to FIG. 1 but improved with a reflective ring according to the present invention.

FIG. 2 shows an improved antenna according to the invention herein in which a reflector ring 12 is added between flat plate 11 and the feed 3.

Transmitted radiation from feed 3 indicated by rays 16 and 17 is successively reflected from subreflector 2 and main reflector 1 as in FIG. 1. The subreflector echo is indicatd by rays 13 and 14. An echo cancelling reflection of equal amplitude and opposite phase to the above echo at the feed location, indicated by ray 15, returns from assembly 10 which is composed of circular flat base plate 11 and an outwardly flared reflecting ring, or wall, 12, which may include differently shaped or oriented segments.

Figure 3:
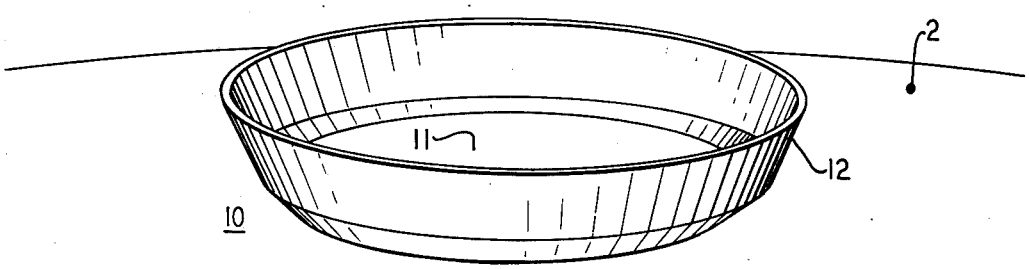
FIG. 3 is a perspective view of the subreflector with flat plate and reflective ring according to the present invention.

Comparison of FIG. 2 with the perspective of the subreflector and echo cancelling assembly in FIG. 3 shows that the echo cancelling assembly 10 is located in the radiation path near and coaxial with subreflector 2. The wall 12 is radially symmetrical so that signal distortions arising from undesirable coupling of signals of different polarizations are minimized. A wall or band in the shape of a regular polygon preferably having a multiple of four sides or approaching a circle provides suitable symmetry in this respect as well. Wall 12 has a narrow rim, but the conical slant of the wall itself presents a significant width aspect to the feed 3.

Wall 12 and plate 11 produce a combined reflection which may be adjusted for suitable cancellation of subreflector echo in two frequency bands. It is believed that this echo cancelling structure acts as an overmoded shorted horn. Experimental observations indicate that the ring-like wall 12 may act to primarily return incident radiation in one frequency band while the plate 11 together with the wall 12 acts to produce a return of incident radiation in the other frequency band. This decoupling of the performance of the structure in two frequency bands assists in extending the frequency range for effective echo cancellation.

Figure 4:
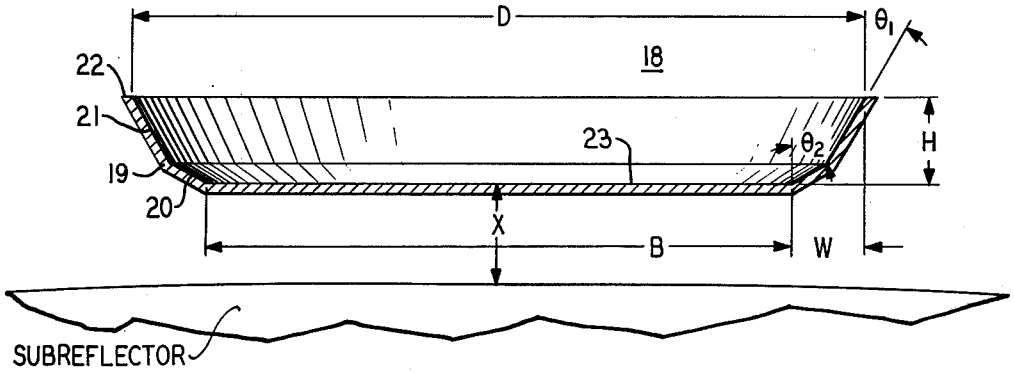
FIG. 4 is an enlarged cross-sectional view of a biconical ring and flat plate structure which may be mounted near the subreflector external to its vertex according to the present invention.

FIG. 4 shows an enlarged cross section of a version 18 of the echo cancelling structure in the radiation path located at a distance X from the subreflector vertex. Base 23 has a reflecting surface of diameter B ringed by outwardly flared wall 19 which has a biconical inner reflecting surface geometry. Conical surface 21 has a flare angle $\theta_1$ which is smaller than the flare angle $\theta_2$ of the conical surface 20 next inward. Wall 19 shows a substantial width aspect W to incident radiation, and wall width W is comparable to the wall height H. By comparison, rim 22 having inside diameter D presents a small width aspect to incident radiation.

Figure 5:
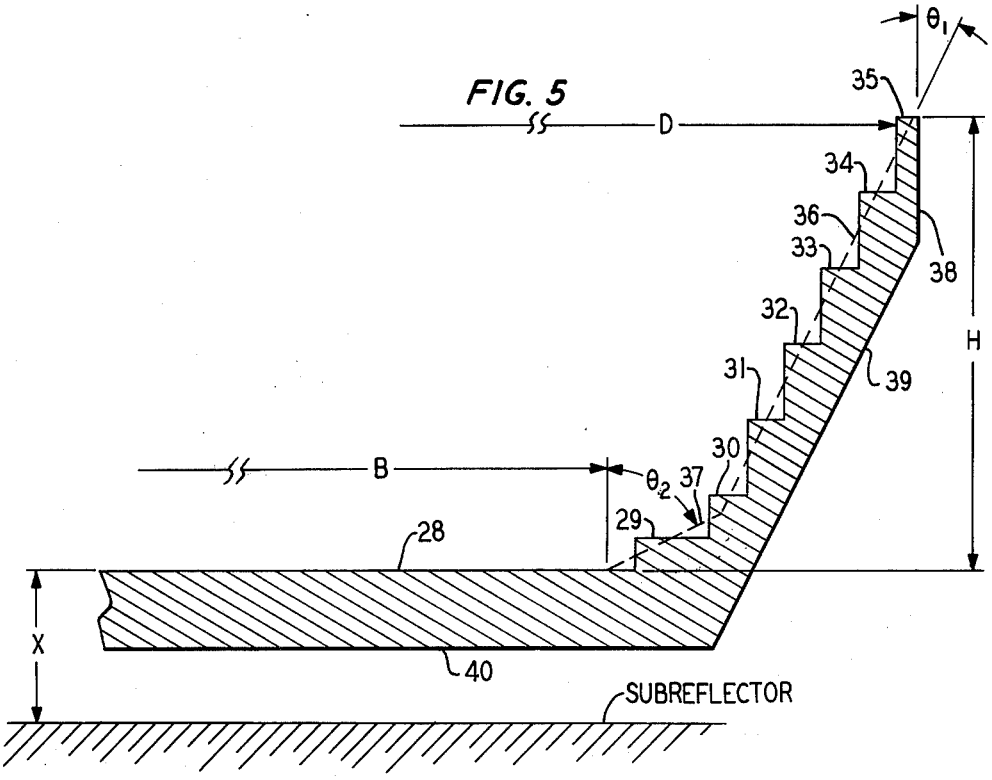
FIG. 5 is a detail of a cross section of a dual frequency serrated biconical ring and flat plate structure according to the present invention.

FIG. 5 shows a detail of the base and modified biconical wall of an echo cancelling structure similar to that of FIG. 4 located in the radiation path at a distance X from the subreflector vertex. Base 40, which can be joined to the subreflector in either fixed or adjustable fashion or can even be part of the subreflector, has reflecting surface 28. Outwardly flaring wall 39 has a biconical average inner surface flare shown as a dashed line including segments 36 and 37 which have flare angles $\theta_1$ and $\theta_2$ respectively. The inner reflecting surface of wall 39 is serrated for reduced specular reflection and resonances so as to have steps 29 and 30 relative to conical portion 37 and steps 31, 32, 33 and 34 relative to the conical portion 36. Rim 35 is cut off at surface 38 and presents a negligible width aspect compared to the rest of the wall. Wall height H, rim inside diameter D, and the base diameter B are defined the same as in FIG. 4. The outer conical surface of wall 39 is shown in cross section to be parallel to dashed line segment 36, but experimentation has shown that a cylindrical extension of surface 38 to the base 40 is permissible without serious degradation.

For advantageous performance characteristics the dimensions of the echo cancelling structure and its position X must be determined. Reference will be made to FIGS. 4 and 5 in disclosing an adjustment method. In order to determine that echo cancellation has been obtained, a measurement technique is used such as the FM-CW swept frequency type. See "Introduction to Radar Cross-Section Measurements" by P. Blacksmith et al., Proceedings of the IEEE, Volume 53, August 1965, pages 901–920. The adjustment of embodiments of the invention herein may be accomplished suitably by an iterative experimental approach such as that suggested below or by other methods familiar to the art.

A microwave antenna is first tested by the use of a flat reflector plate such as plate 4 of FIG. 1. That plate diameter and distance X from the subreflector 2 required for cancellation are determined first by measurement in the lower frequency range and then again, for the higher frequency range.

The base diameter dimension B in FIG. 4 is assigned a trial value equal to the diameter of the flat plate which provides cancellation in the higher frequency range. The rim inside diameter D is assigned a trial value larger by the factor $1 + 0.16\ (f_h - f_1)/f_1$ than the diameter of the flat plate which provides cancellation in the lower frequency range. The $f_h$ and $f_1$ are the center frequencies of the higher and lower frequency ranges respectively. The height H of the outwardly flaring wall of FIG. 4 is given a trial value $$H = 5.4\ \Delta X \qquad 1$$

where $\Delta X$ is the difference in the above-mentioned measured cancellation distances with flat plates. $\theta_1$ is assigned an experimentally determined trial value of 27°, and $\theta_2$ has a nominal value of 60°. Given the trial dimensions suggested, a trail echo cancelling structure may be constructed. If it is found from the trail dimensions that no surface 20 in FIG. 4 is required, the geometry reduces to that of a single conical inner surface segment.

In testing the trial echo cancelling structure in the antenna to be improved, an iterative experimental procedure is suggested to determine the best dimensions and location. The structure is mounted adjustably on subreflector 2. Two distances $X = X_1$ and $X = X_2$ to the illuminated side of the base are measured from the subreflector vertex, corresponding to cancellation nulls within the lower and higher frequency ranges, respectively. If a cancellation null is not sufficiently pronounced, an adjustment in the amplitude of the reflection may be made by proportionally increasing or decreasing the area presented by the structure. For example, if the higher frequency cancelling reflection has excessive amplitude, the base diameter B is decreased. If the lower frequency cancelling reflection amplitude is insufficient, the rim inside diameter D is increased.

If positions $X_1$ and $X_2$ are equal, or if an $X$ between different $X_2$ and $X_1$ suffices to yield adequately cancelling phases throughout both frequency ranges, then $X$ is determined. However, if it is necessary that $X_2$ and $X_1$ approach each other more closely, the outer flare angle $\theta_1$ must be experimentally adjusted until acceptable performance in both frequency ranges is obtained. $H$ may also be varied. If $X = 0$ so that the reflecting surface of the base coincides with the subreflector surface, then an antenna according to the invention may be fashioned by simply joining the outwardly flaring wall to the subreflector itself.

In an embodiment of the invention for use in the above-mentioned 500 MHz common carrier bands at 4 and 6 GHz, $B$ is 6-⅛ inches, $D$ is 7-⅛ inches, $H$ is ¾ inch, $X$ is about 1/12 inch, $\theta_1$ is 27°, and $\theta_2$ is 57°, with a base and a stepped ring-like wall as shown in FIG. 5. The subreflector echo return loss measured at the feed is better than 40 dB for every frequency in the above-mentioned common carrier bands in an antenna having a 10-foot diameter, shaped subreflector and a 100-foot diameter shaped main reflector.

It is to be understood that the above-described versions of the invention herein are merely illustrative off many possible arrangements. A variety of band or ring sizes and geometries may be employed between the feed system and the subreflector, together with a reflective base, if a base be needed or desired. The improvements described hereinabove need not be limited to the particular type of antenna illustrated. In these and other respects, it is to be understood that a wide variety of embodiments are comprehended in the spirit and scope of the invention.

I claim:

1. An antenna having a main reflector, a smaller subreflector, and feeding means so arranged that radiation from said feeding means is reflected successively from said subreflector and said main reflector, wherein the improvement comprises a reflective band located near said subreflector between said subreflector and said feeding means, said band having a significant width aspect and having an inner surface flaring outward toward said feeding means, whereby radiation from said feeding means reflected back to said feeding means by said subreflector is substantially cancelled in both a lower and a higher frequency range.

2. An antenna as claimed in claim 1 wherein said main reflector, said subreflector and said feeding means form a Cassegrainian antenna and said reflective band is joined to said subreflector.

3. An antenna as claimed in claim 1 wherein said antenna further comprises reflector means smaller than said subreflector and mounted between said reflective band and said subreflector.

4. An antenna as claimed in claim 3 wherein said reflector means has a perimeter and said band is a symmetric conductive wall electrically connected to said perimeter and having an inner surface flaring outward toward said feeding means.

5. An antenna as claimed in claim 4 wherein said inner surface of said wall flares biconically outward toward said feeding means with a successively decreased flare angle.

6. An antenna as claimed in claim 4 wherein said wall has a stepped inner surface with a biconical average flare.

7. An antenna having a main reflector, a subreflector, and a feed system in spatial relationship to each other such that radiation from said feed system is reflected from said subreflector and then from said main reflector, and a plate mounted near said subreflector in the path of said radiation wherein the improvement comprises a wall surrounding said plate and having an inner surface flaring outward toward said feed system, whereby radiation from said feed system reflected back to said feed system by said subreflector is substantially cancelled by a reflection from said plate and said wall.

8. An antenna as claimed in claim 7 wherein said main reflector is essentially paraboloidal and said subreflector is essentially hyperboloidal and said plate and said wall are adjustably mounted to relative to said subreflector.

9. An antenna as claimed in claim 7 wherein said inner surface of said wall has a plurality of conical portions each having a flare angle smaller than any next inner portion.

10. An antenna as claimed in claim 7 wherein said inner surface of said wall is serrated in cross section.

* * * * *